US008633863B2

(12) United States Patent
Desclos et al.

(10) Patent No.: US 8,633,863 B2
(45) Date of Patent: Jan. 21, 2014

(54) MODAL ADAPTIVE ANTENNA USING PILOT SIGNAL IN CDMA MOBILE COMMUNICATION SYSTEM AND RELATED SIGNAL RECEIVING METHOD

(75) Inventors: Laurent Desclos, San Diego, CA (US); Sebastian Rowson, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 13/548,895

(22) Filed: Jul. 13, 2012

(65) Prior Publication Data

US 2013/0093635 A1 Apr. 18, 2013

Related U.S. Application Data

(63) Continuation-in-part of application No. 13/029,564, filed on Feb. 17, 2011, now Pat. No. 8,362,962, and a continuation of application No. 12/043,090, filed on Mar. 5, 2008, now Pat. No. 7,911,402.

(51) Int. Cl.
*H01Q 21/12* (2006.01)

(52) U.S. Cl.
USPC ..... 343/815; 343/745; 343/833; 343/834

(58) Field of Classification Search
USPC ..... 343/700, 815, 817, 818, 833, 834, 745
See application file for complete search history.

(56) References Cited

U.S. PATENT DOCUMENTS

| | | | | |
|---|---|---|---|---|
| 6,326,921 | B1 * | 12/2001 | Egorov et al. | 343/700 MS |
| 6,456,249 | B1 * | 9/2002 | Johnson et al. | 343/702 |
| 6,650,294 | B2 * | 11/2003 | Ying et al. | 343/700 MS |
| 7,265,724 | B1 * | 9/2007 | Tan et al. | 343/702 |
| 2005/0245204 | A1 * | 11/2005 | Vance | 455/80 |
| 2006/0022889 | A1 * | 2/2006 | Chiang et al. | 343/833 |
| 2007/0188390 | A1 * | 8/2007 | Dunn et al. | 343/702 |
| 2008/0001829 | A1 * | 1/2008 | Rahola et al. | 343/702 |

* cited by examiner

*Primary Examiner* — Tho G Phan
(74) *Attorney, Agent, or Firm* — Coastal Patent Law Group, P.C.

(57) ABSTRACT

One or more input signals are used to generate a Pseudo noise generator and re-inject the signal to obtain a more efficient method of control of a receiver using adaptive antenna array technology. The antenna array automatically adjusts its direction to the optimum using information obtained from the input signal by the receiving antenna elements. The input signals may be stored in memory for retrieval, comparison and then used to optimize reception. The difference between the outputs of the memorized signals and the reference signal is used as an error signal.

4 Claims, 12 Drawing Sheets

MODAL ADAPTIVE ANTENNA USING PILOT SIGNAL IN CDMA MOBILE COMMUNICATION SYSTEM AND RELATED SIGNAL RECEIVING METHOD

CROSS-REFERENCE TO RELATED APPLICATIONS

This application is a CIP of U.S. patent application Ser. No. 13/029,564, filed Feb. 17, 2011, and titled "Antenna and Method for Steering Antenna Beam Direction";

which is a CON of U.S. patent application Ser. No. 12/043,090, filed Mar. 5, 2008, and titled "Antenna and Method for Steering Antenna Beam Direction", issued as U.S. Pat. No. 7,911,402 on Mar. 22, 2011;

the contents of each of which are hereby incorporated by reference.

BACKGROUND OF THE INVENTION

1. Field of the Invention

This invention relates to code division multiple access (CDMA) mobile communication systems, and more particularly, to a modal adaptive antenna system and related signal receiving methods.

2. Description of the Related Art

In a classical operation of a smart antenna system, the array input vectors are applied to multipliers forming the adaptive array, a summing circuit and an adaptive processor for adjusting the weights.

The signals are multiplied by weighted outputs from the adaptive processor. It takes a long period of time for the adaptive processor to process the calculations in addition the adaptive processor is complicated. Consequently it is difficult to apply a classical scheme.

It is generally known in the art that these classical systems require extended periods of time for the adaptive processor to process calculations for signal receiving. Additionally, the circuit of the adaptive processor is complicated, and therefore it is difficult to apply the conventional smart antenna system to CDMA mobile communications.

More recently, demand has driven requirements for smart antenna systems configured for use in code division multiple access (CDMA) mobile communication systems and applications. In order to overcome some of the previous limitations, new and improved antenna systems and methods are being developed.

One example of a smart antenna receiver for use in CDMA applications is described in U.S. Pat. No. 6,353,643 by Park, hereinafter the '643 patent, the entire contents of which are hereby incorporated by reference. In the '643 patent, Park discloses a method for including the use of a pilot signal to enable a pseudo noise generator and re-inject the signal to get a more efficient method of control. Although Park suggests methods for improving prior art smart antenna systems, there is a continuing need for improved antenna systems and methods for increased efficiency in signal receiving.

Modernly, it is therefore a requirement in the dynamic field of mobile communications to provide improved and more efficient methods of signal receiving and processing. Current trends and demand in the industry continue to drive improvements in signal receiving and processing for mobile CDMA communications systems.

SUMMARY OF THE INVENTION

It is therefore an object of the invention to provide a smart antenna receiver using adaptive antenna array technology that automatically adjusts its direction to the optimum position for reception using information obtained from the input signal of the receiving antenna elements.

The invention describes a method of receiving structure based on a modal approach for the antenna. Since the antenna is tuned in several steps driving from one mode to the other, several radiation patterns will be established in memory corresponding to several states stored in a Look-Up table. The Look-Up table corresponds to a set of voltages applied to both parasitic elements corresponding to the different capacitors or inductors placed to obtain the optimal radiation patterns.

In certain embodiments the use of a diversity signal as a reference and will help to generate a signal that controls the adaptive processor.

BRIEF DESCRIPTION OF THE DRAWINGS

These and other attributes of the invention are further described in the following detailed description of the invention, particularly when reviewed in conjunction with the drawings, wherein.

DETAILED DESCRIPTION

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

A multimode antenna, or "modal antenna", is described in commonly owned U.S. Pat. No. 7,911,402, issued Mar. 22, 2011, hereinafter referred to as the "'402 patent", the contents of which are incorporated by reference. The modal antenna of the '402 patent generally comprises an isolated magnetic dipole (IMD) element having one or more resonance portions thereof disposed above a circuit board to form a volume of the antenna. A first parasitic element is positioned between the IMD element and the circuit board within the volume of the antenna. A second parasitic element is positioned adjacent to the IMD element but outside of the antenna volume. Due to proximity of these parasitic elements and other factors, the first parasitic element is adapted to shift a frequency response of the antenna to actively tune one or more of the antenna resonance portions, and the second parasitic element is adapted to steer the antenna beam. In sum, the modal antenna of the '402 patent is capable of frequency shifting and beam steering. Moreover, where the antenna beam comprises a null, the null can be similarly steered such that the antenna can be said to be capable of null steering. For purposes of illustration, the modal antenna of the '402 patent provides a suitable example for use in the invention; however, it will be understood that other modal antennas may be used with some variation to the embodiments described herein.

Figure 1:
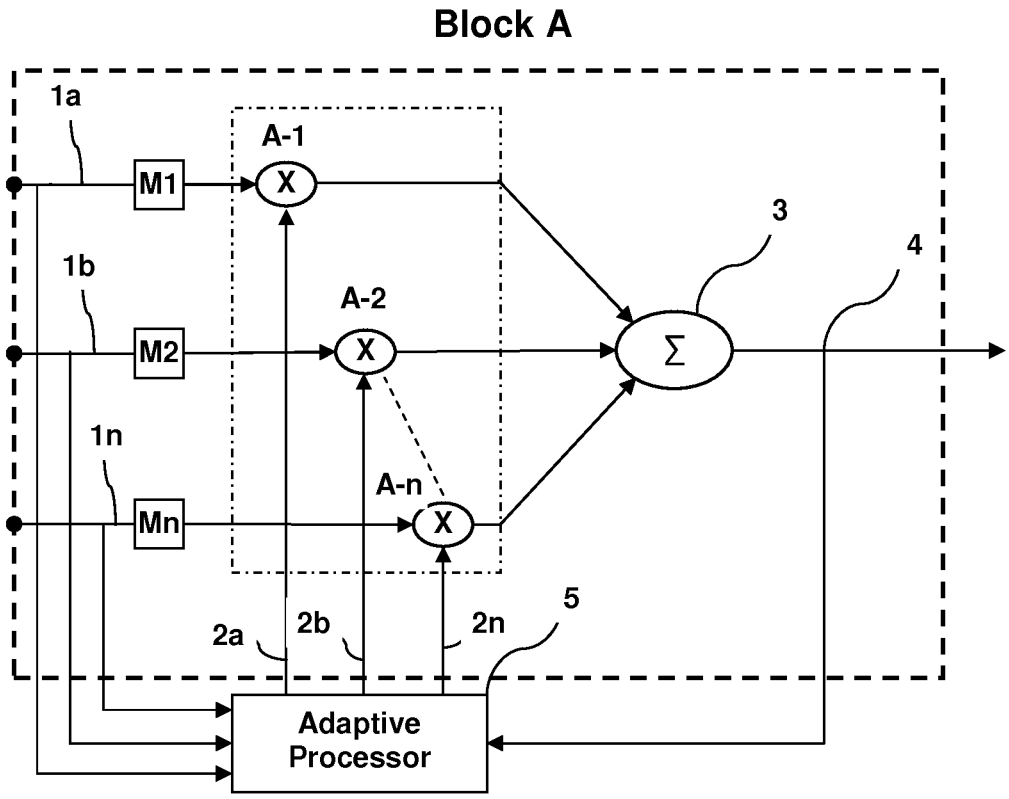
FIG. 1 illustrates a circuit for a smart antenna receiver including multiple inputs which are stored in memory and then compared to an error signal. A feedback loop monitors the changes and adjusts the output for optimum reception.

Now turning to the drawings, FIG. 1 illustrates a circuit for a smart antenna system, wherein multiple radio signals 1*a* through 1*n* are received and stored in memory M1 through Mn. The stored signals in memory M1 through Mn are then multiplied by a set of weights 2*a* through 2*n* that are derived from an adaptive processor 5 and combined at combiners A-1 through A-n. The output signals from A-1 through A-n are combined in a summing circuit 3 to generate an output signal 4. The summing circuit output 4 and the constantly changing inputs 1*a* through 1*n* are analyzed by the adaptive processor 5 to provide the weighted signals 2*a* through 2*n*. This circuit generally provides a memory-enhanced spatial filter for use in a smart antenna system, where a bank of signals can be stored in memory and used for enhanced signal processing. Additionally, the circuit of FIG. 1 is capable of being used with a single multi-mode antenna unit. In certain embodiments, the multi-mode antenna provides reduced space and improved efficiency over multi-array antennas for operation at a similar signal range.

Figure 2:
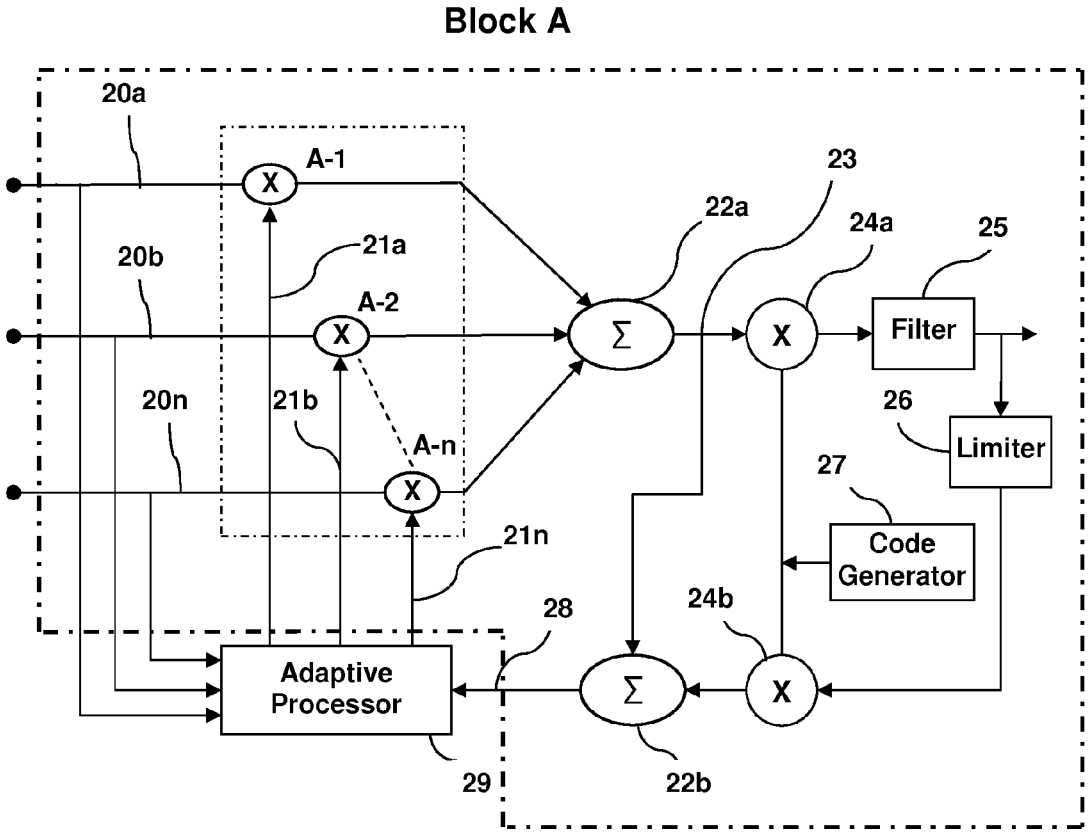
FIG. 2 illustrates a smart antenna receiver including multiple inputs that are continually compared to an error signal. The output signal is processed to obtain an error signal that changes and adjusts the output for optimum reception.
Figure 10A:
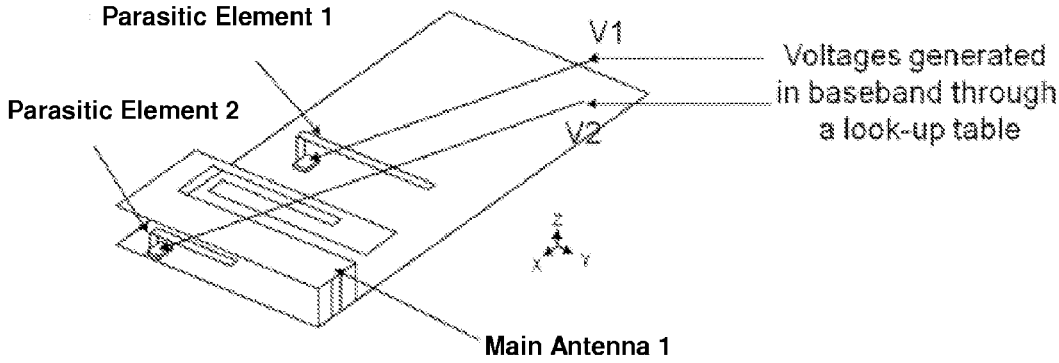
FIG. 10*a* illustrates an embodiment of the invention where an antenna is positioned between a plurality of parasitic elements for generating a series of modes at which the antenna operates; the multi-mode antenna is included in smart antenna system with voltages applied to parasitic elements that change the angle of the radiation pattern for the Main Antenna 1.
Figure 10B:
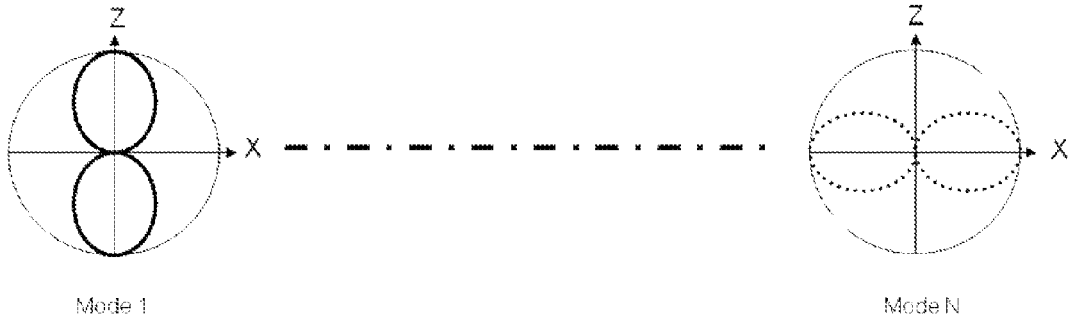
FIG. 10*b* illustrates the radiation pattern modes as can be generated using the multi-mode antenna system of FIG. 10*a*.

FIG. 2 illustrates a circuit for a smart antenna system, wherein multiple radio signals 20*a* through 20*n* are received and multiplied with a set of weights 21*a* through 21*n* at A-1 through A-n. Weighted signals 21*a* through 21*n* are derived from an Adaptive Processor 28 and provide inputs to at A-1 through A-n to generate an input signal to summing circuit 22*a*. The output signal 23 is then multiplied by a pseudo noise code 27 at 24*a* detected by the pilot signal to generate a de-spread signal that is then filtered at 25. The amplitude of the filtered signal is adjusted by Limiter 26 and then multiplied at 24*b* by the pseudo noise code generator 27 to generate a reference signal 28 from summing circuit 24*b*. The difference between the outputs 20*a* through 20*n* and the reference signal 28 is used as an error signal. An optimum weighted set is generated by using the generated error signal and the radio signals 21*a* through 21*n*. The circuit of FIG. 2 is further adapted for use with a multi-mode antenna unit as will be further described below and is illustrated in FIG. 10(*a-b*).

Figure 3:
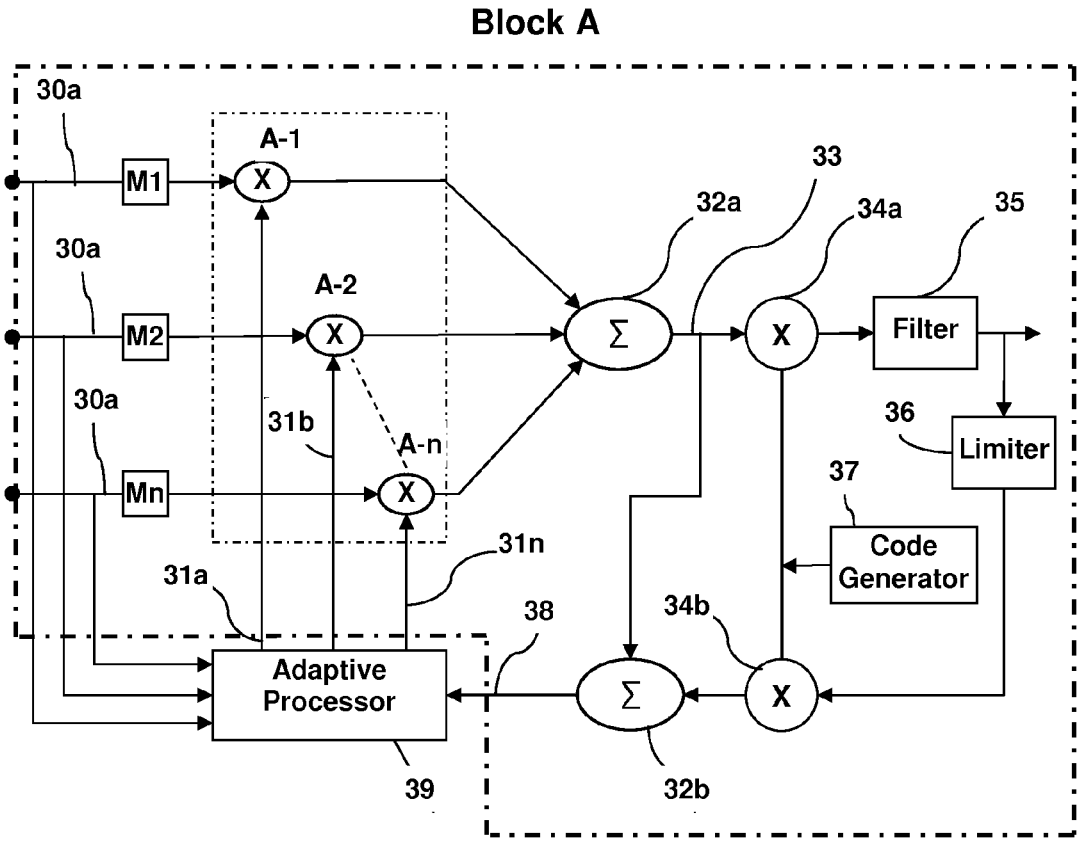
FIG. 3 illustrates a smart antenna receiver including multiple inputs that are stored and continually compared to an error signal. The output signal is processed to obtain an error signal that changes and adjusts the output for optimum reception by being compared to the stored signals.

FIG. 3 illustrates a circuit for a smart antenna system, wherein multiple radio signals 30*a* through 30*n* are received and stored in M1 through Mn. The stored signals M1 through Mn are then multiplied with a set of weights 31*a* through 31*n* at A-1 through A-n. Weighted signals 31*a* through 31*n* are derived from an Adaptive Processor 38 and provide inputs to A-1 through A-n to generate an input signal to summing circuit 32*a*. The output signal 33 is then multiplied by a pseudo noise code 37 at 34*a* detected by the pilot signal to generate a de-spread signal that is then filtered at 35. The amplitude of the filtered signal is adjusted by Limiter 36 and then multiplied at 34*b* by the pseudo noise code generator 37 to generate a reference signal 38 from summing circuit 34*b*. The difference between the outputs 30*a* through 30*n* and the reference signal 38 is used as an error signal. An optimum weighted set is generated by using the generated error signal and the radio signals 31*a* through 31*n* and the stored signals at M1 through Mn.

Figure 4:
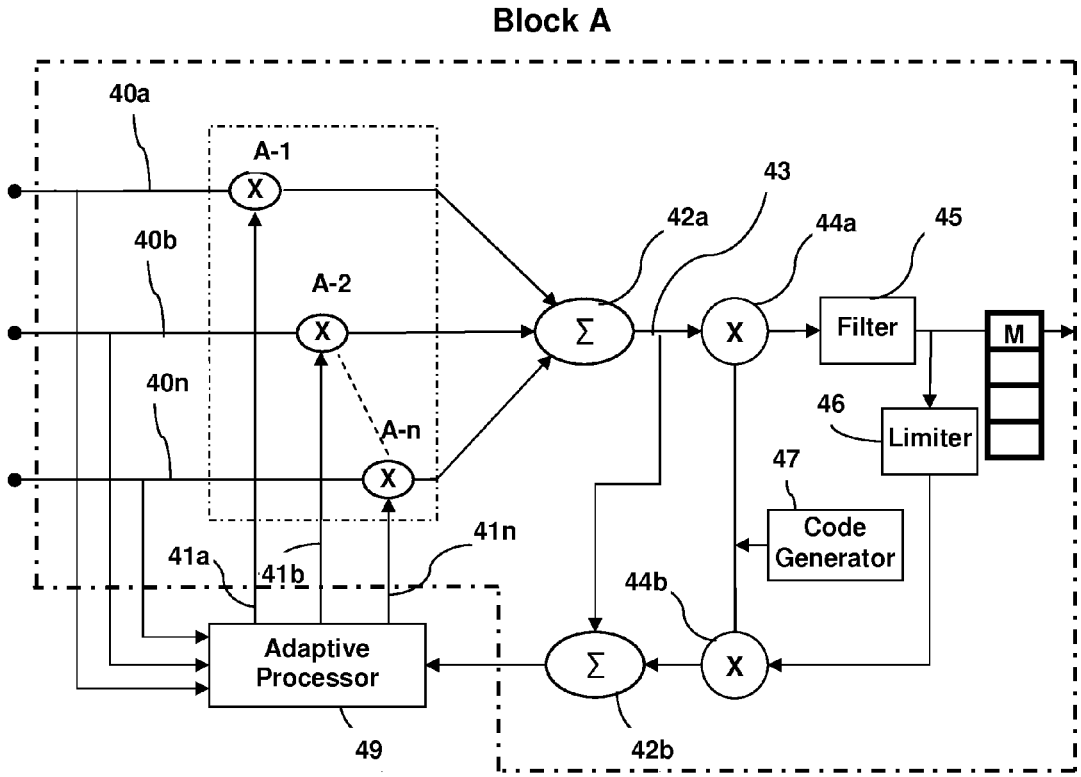
FIG. 4 illustrates a smart antenna circuit that is identical in operation to FIG. 2 except for the addition of a memory storage circuit at the output.

FIG. 4 is identical in operation to FIG. 2 with the addition of a memory storage device at the output to store the output signal in memory.

Figure 5:
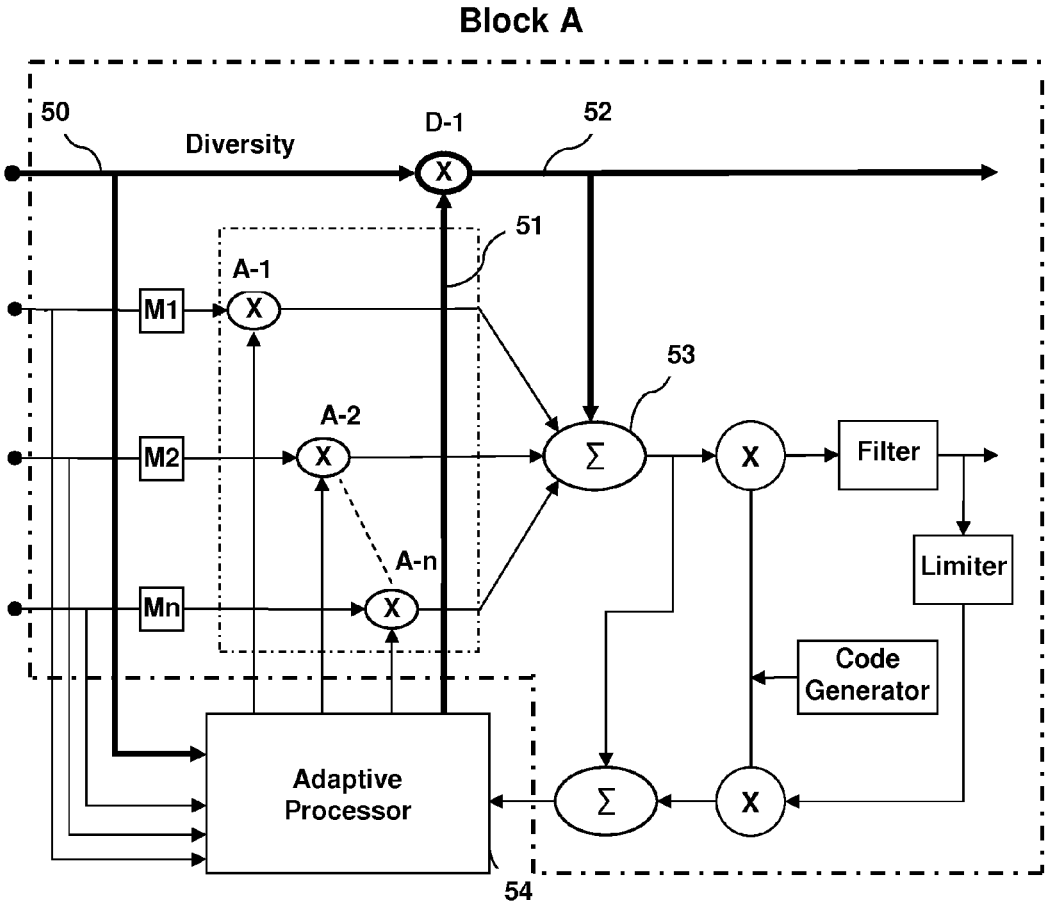
FIG. 5 illustrates a smart antenna circuit that is identical in operation to FIG. 3 except for the addition of a diversity signal that provides an additional reference for control of the adaptive processor.

FIG. 5 is identical in operation to FIG. 3 except for the addition of a diversity signal 50 that provides an additional reference for control of the adaptive processor 54. An additional weighted signal 51 is generated and combined with the input signal 50 at D-1. The output signal 52 is summed at 53.

Figure 6:
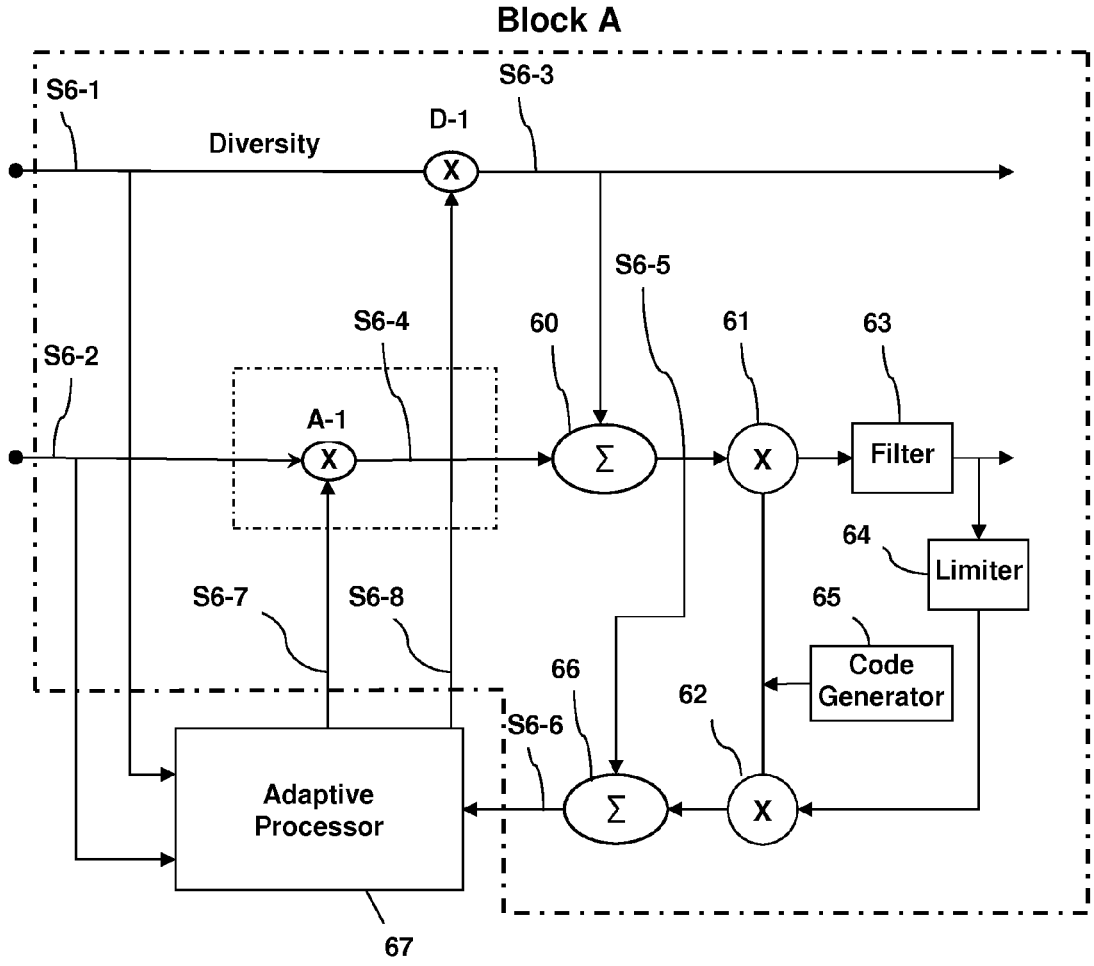
FIG. 6 illustrates a circuit for a smart antenna receiver including a single input that is continually compared to an error signal. The diversity signal provides an additional reference for control of the adaptive processor.

FIG. 6 illustrates a circuit for a smart antenna system, wherein a single radio signal S6-2 is received and multiplied with a weighted signal S6-7 generated by the adaptive processor 66 at A-1. In addition, a diversity signal S6-1 is generated and multiplied with a weighted signal S6-8 by the adaptive processor 67 at D-1.

The weighted signals S6-7 and S6-8 are generated by comparing the two inputs S6-1 and S6-2 with a reference signal S6-6. The reference signal S6-6 is derived by summing the diversity signal output S6-3 and the output of A-1 (S6-4) at 60.

The summing output signal S6-5 is then multiplied by a pseudo noise code generator 65 at 61 to generate a de-spread signal that is then filtered at 63. The amplitude of the filtered signal is adjusted by Limiter 64 and then multiplied at 62 by the pseudo noise code generator 65 to generate a reference signal S6-6 from summing circuit 66.

The difference between the inputs S6-1 and S6-2 and the reference signal S6-6 is that reference signal S6-6 is analyzed by the adaptive processor to produce the weighted outputs S6-7 and S6-8.

Each of the circuits illustrated in FIGS. 1-6 includes a portion captioned as "Block A". Block A is a general reference relating to any of the circuits captured in FIGS. 1-6, where these circuits can be further used in an advanced smart antenna system to provide improved methods for signal receiving. Additionally, each of the circuits of FIGS. 1-6 can be adapted for use with a multi-mode antenna unit for reduced space and improved performance of the smart antenna system.

Figure 7:
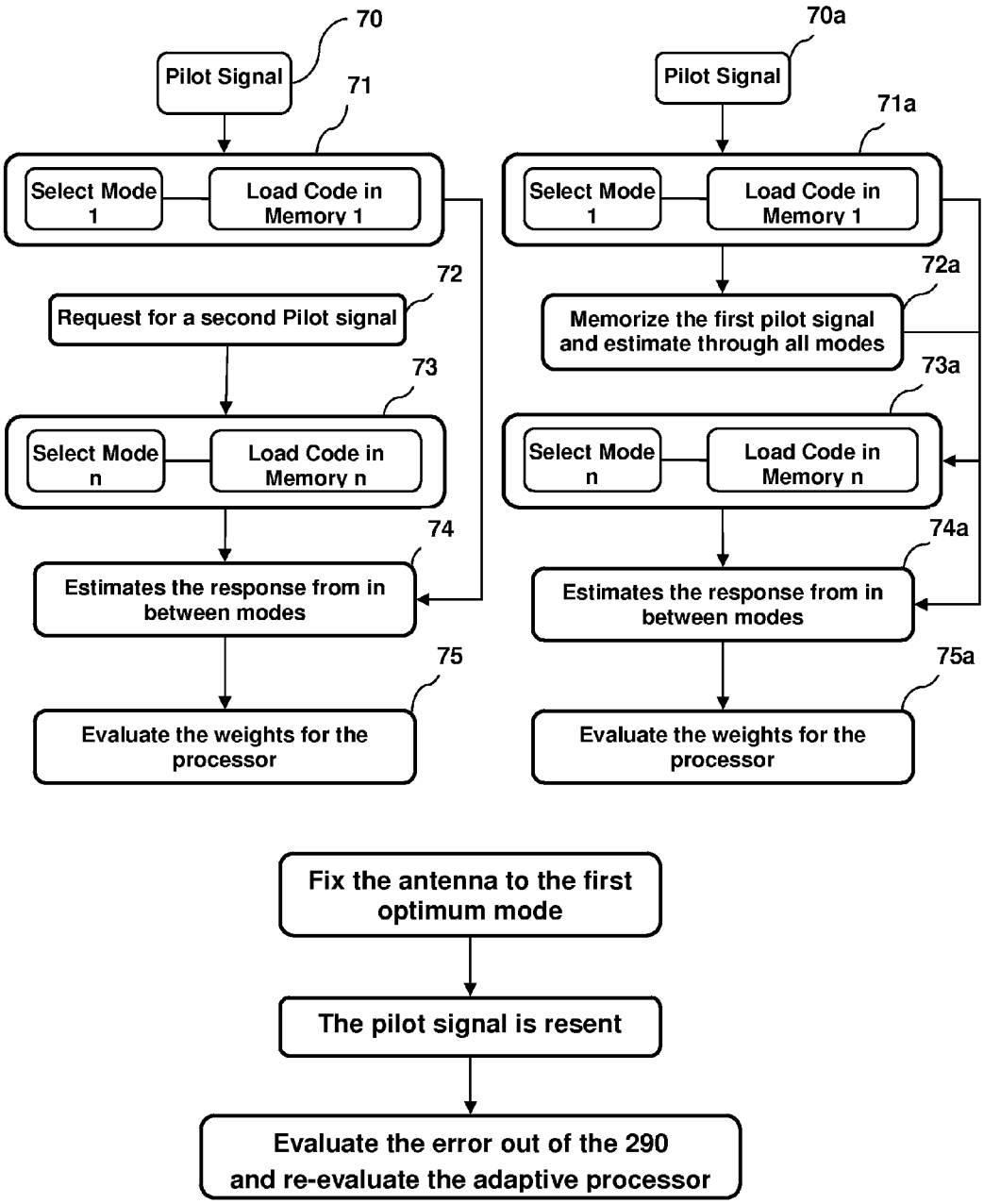
FIG. 7 illustrates a block diagram showing the flow between transmit and receive functions based on a simple level of error that could be determined with the levels in the different schemes shown in FIGS. 1-6.

FIG. 7 illustrates a flow diagram describing the process of sampling the response from the multiple antenna modes and developing weights for each mode. A pilot signal 70 is received when the antenna mode 71 is set to the first mode. A second pilot signal 72 is sampled with the antenna set to the second mode 73 and this process is repeated until all modes have been sampled. An estimation of antenna performance that occurs between sampled modes 74 is made. Weights are evaluated for the processor 75 based upon the sampled antenna responses for the various modes n. The adaptive process is highlighted starting in 70*a* where a pilot signal is received for antenna mode 1 71*a*. The receive response is stored and compared to previous received responses for mode 1 and estimates are made for receive response for the other antenna modes 72*a* and 73*a*. An estimate of antenna performance between sampled modes is performed 74*a*. Weights are evaluated for the processor 75*a* based on the sampled and estimated antenna response for the modes.

Figure 8:
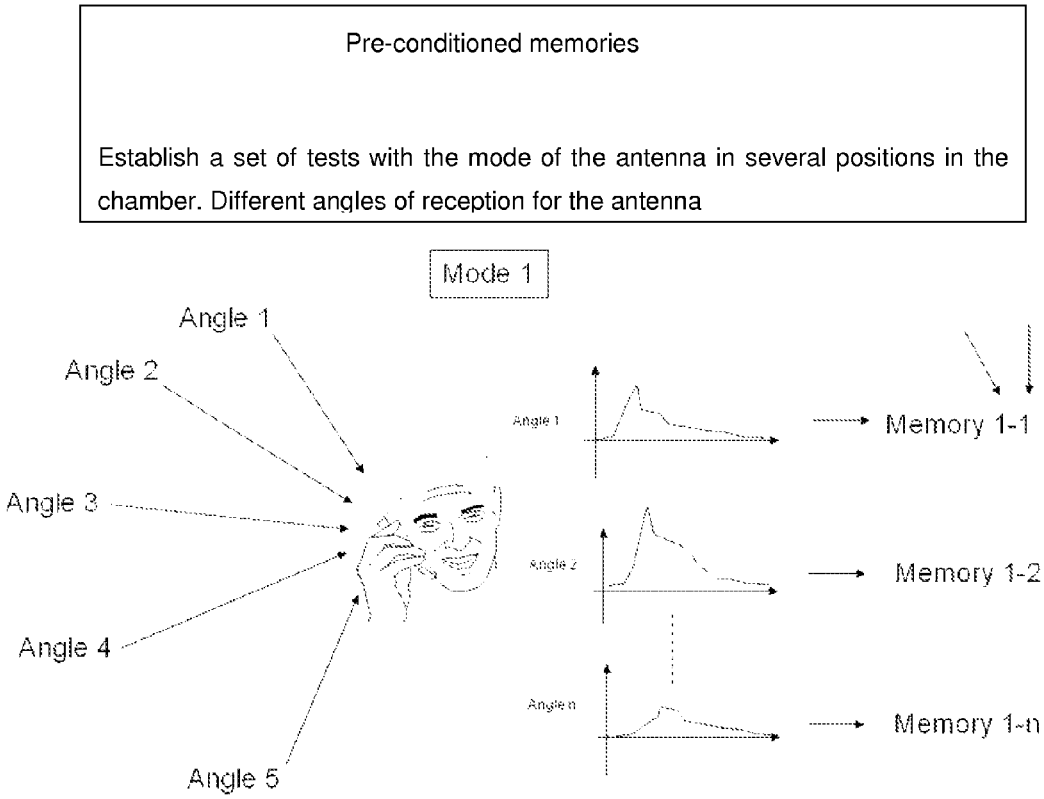
FIG. 8 illustrates a method wherein a controlled analysis is required in a chamber to determine memory settings.

FIG. 8 provides a description of a method in one embodiment of the invention, wherein an analysis of the signal is required in a test chamber where all the modes are characterized and memorized for settings in the cell phone. This insures that measurements are made in a controlled environment.

Figure 9:
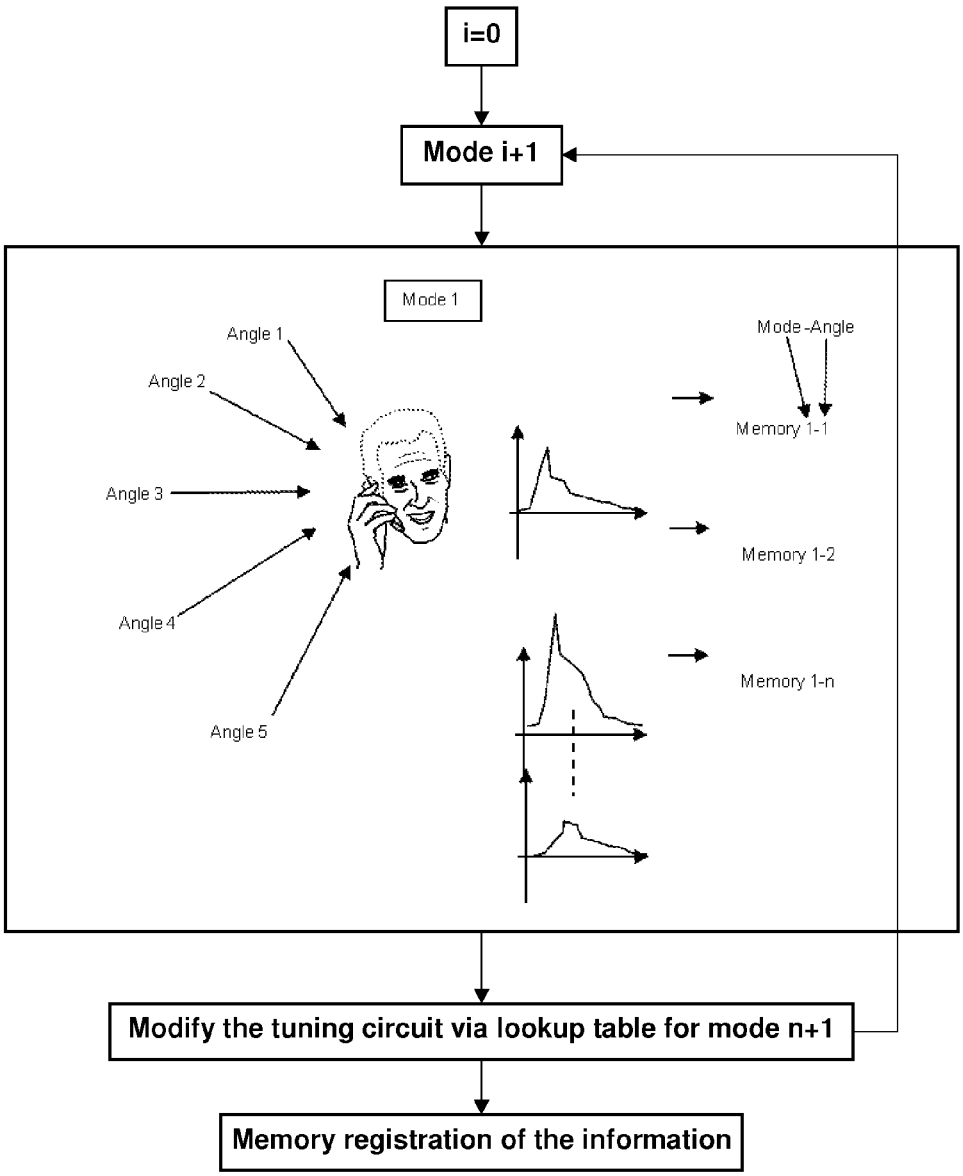
FIG. 9 illustrates a flow chart describing a method including the utilization of a Look-Up Table to generate voltages for maximum signal reception based upon the angle of the received input signal.

FIG. 9 illustrates a flow chart that describes the generation of voltages for maximum signal reception based upon the angle of the maxima or minima of the antenna radiation pattern (or any other parameters driving the antenna performances). The mode and angle are stored successively in memory using sample and hold circuitry and are retrieved from the Look-Up Table. The mode is initially set to 0 and then incremented in steps where an Antenna Tuning Module is more finely tuned to achieve the optimum mode. The result is stored in memory for retrieval.

FIG. 10(*a-b*) illustrate an exemplary physical example of a multi-mode smart antenna with voltages V1 and V2 applied to parasitic elements 1 and 2 used to modify the angle of maxima and/or minima of the radiation pattern (or any other parameters driving the antenna performances) for the Main Antenna 1 as shown for Mode 1 through Mode n. The voltages V1 and V2 are derived from a Look-Up table and are generated based upon changes in the input signals utilizing the methods described in this application.

Figure 11:
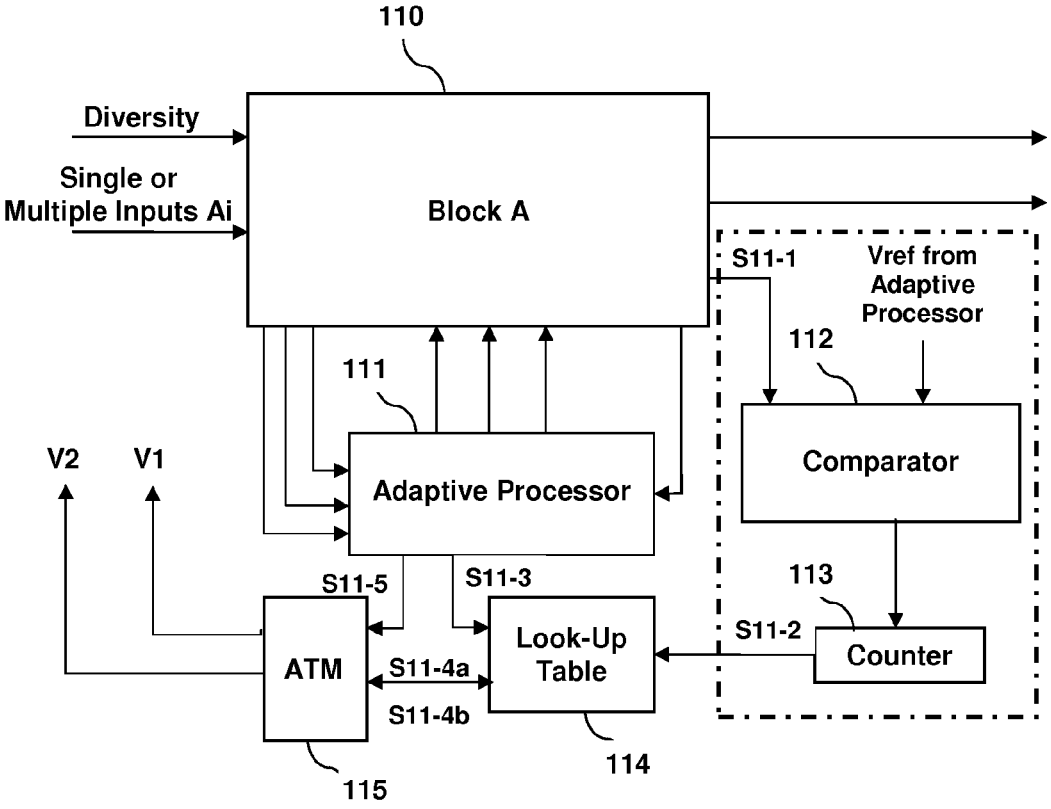
FIG. 11 illustrates a circuit that produces reference voltages used to determine the mode of operation as shown in FIG. 10(*a-b*). Any one of FIGS. 1-6 could be used for Block A.

FIG. 11 illustrates a circuit for a smart antenna system, wherein Block A represents any of the circuits of FIGS. 1-6 with Diversity and either single or multiple inputs Ai as shown again in FIGS. 1-6. The Adaptive Processor 110 can be included in Block A if required.

An output from Block A S11-1 is compared with voltage reference signal Vref at 112. The output of the Comparator 112 increments or decrements a Counter 113 based upon the Comparator 112 output.

The Counter output signal S11-2 in conjunction with an output S11-3 from the Adaptive Processor 111 and a bi-directional signal 511-4*a* from the Automatic Tuning Module 115 determine the output required from the Look-Up Table 114.

This resultant signal 11-4*b* in conjunction with signal S11-5 from the Adaptive Processor 111 are used to determine the outputs V1 and V2 from the Automatic Tuning Module 115. See FIG. 10 for the physical representation of the application of V1 and V2.

Figure 12:
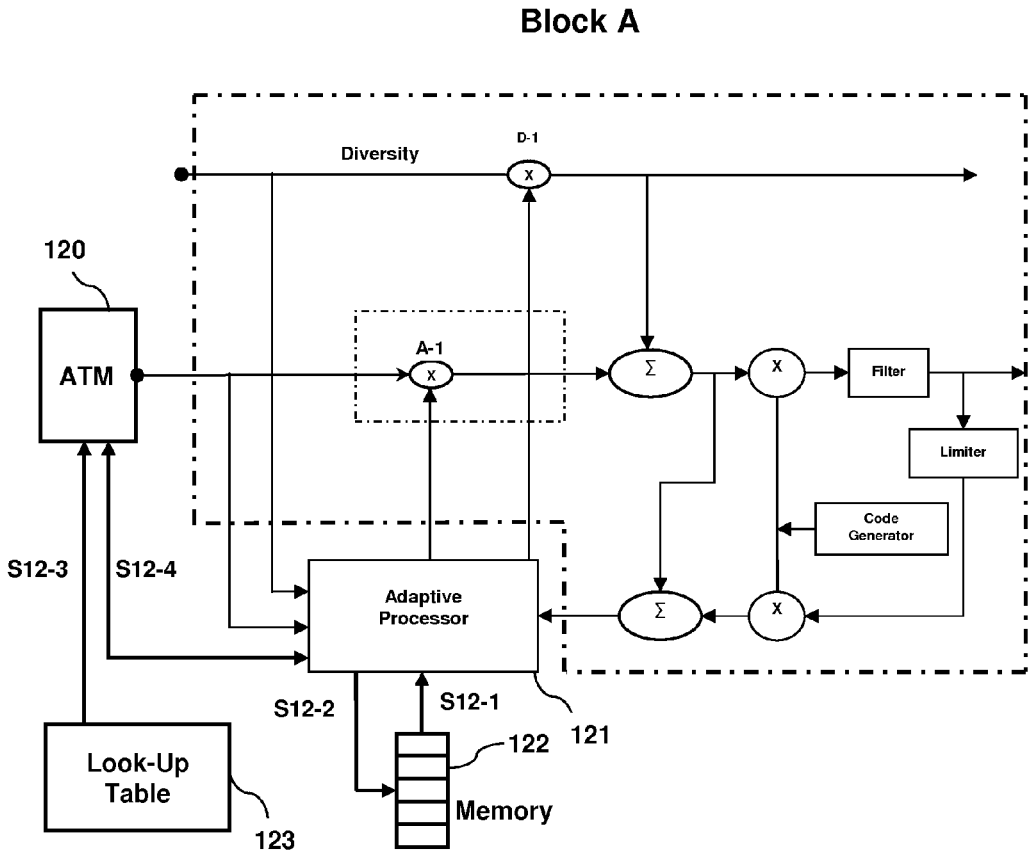
FIG. 12 illustrates an exemplary example of utilizing an Antenna Tuning Module (ATM) that produces a single input signal to a circuit shown in FIG. 6 derived from a Look-Up table and an Adaptive Processor.

FIG. 12 illustrates a circuit for a smart antenna system, wherein Block A represents any of the circuits of FIGS. 1-6 with a Diversity signal and single input from the Automatic Tuning Module 120. The Adaptive Processor 121 can be included in Block A if required.

An output S12-2 from the Adaptive Processor 121 is used to determine the output from a Memory circuit 122. This output S12-1 is used to update Adaptive Processor 121.

The output from the Automatic Tuning Module 120 is derived from two signals, S12-3 from the Look-Up Table 123 and a bi-directional signal S12-4 that provides both input and output signals to update the Adaptive Processor 121 and tune Automatic Tuning Module 120.

The circuits illustrated in FIGS. 11-12 can be adapted for use with a multi-mode antenna unit, such as an isolated magnetic dipole antenna element (IMD) and one or more parasitic elements positioned near the IMD antenna element. Alternatively, the circuits illustrated in FIGS. 11-12 can be further adapted for use with a multi-array antenna unit.

As described above, a smart antenna system includes a spatial filter comprising a plurality of multipliers, a summer, and an adaptive processor. The smart antenna system can further include memory for storing radio signals at the input.

Additionally, the smart antenna system can further include: a pseudo noise code generator and a multiplier for multiplying the signal with the pseudo noise code; a data bandwidth filter for eliminating the interference component by filtering a despread signal; a limiter for adjusting amplitude of the signal having an omitted interference component; a multiplier for generating a re-spread reference signal by multiplying the amplitude adjusted signal by the pseudo noise code; and a subtracter for generating an error signal.

Furthermore, the smart antenna system can include one or more of: a memory module positioned at the output of the smart antenna circuit; a diversity signal for further reference and improved signal processing; a comparator for comparing the voltage of a Block A circuit with a $V_{ref}$ provided by the adaptive processor; a counter for generating a counter output signal for determining the output required from a look-up table; a look-up table, and an antenna tuning module for dynamic tuning of the antenna system.

While the invention has been shown and described with reference to one or more certain preferred embodiments thereof, it will be understood by those having skill in the art that various changes in form and details may be made therein without departing from the spirit and scope of the invention as defined by the appended claims.

What is claimed is:

1. A modal antenna system, comprising:

a modal antenna, and a memory-enhanced spatial filter for use with the modal antenna;

said modal antenna comprising:

an antenna radiator disposed above a circuit board forming an antenna volume therebetween;

a first frequency tuning parasitic element connected to said circuit board and positioned between the circuit board and the antenna radiator within the antenna volume, and a second beam steering parasitic element positioned outside of the antenna volume and adjacent to the antenna radiator;

said memory-enhanced spatial filter for use with the modal antenna comprising:

an adaptive processor adapted to receive a plurality of input radio signals and deliver weighted signals therefrom;

a plurality of memory modules each being adapted to store one of said input radio signals;

a plurality of signal combiners, each of said signal combiners being connected to one of said memory modules and further connected to said adaptive processor, the signal combiners each being adapted to combine the corresponding input radio signal from the connected one of said memory modules with the weighted signal from said adaptive processor to form an output signal, the signal combiners collectively forming a plurality of output signals; and a summing circuit connected to each of said signal combiners and adapted to sum each of the output signals from said signal combiners to form an enhanced signal, the summing circuit being further adapted to resample the enhanced signal through said adaptive processor for actively reconfiguring the enhanced signal and adjusting said weight signals;

wherein a bank of said input radio signals is stored in said memory and used for enhanced signal processing for use with a single modal antenna.

2. The modal antenna system of claim 1, said memory-enhanced spatial filter further comprising:

a code generator adapted to generate a pseudo noise code detected by a pilot signal;

a noise signal combiner connected to the code generator and the summing circuit and adapted to combine the enhanced signal and said pseudo noise code to form a despread signal;

a filter connected to the noise signal combiner and adapted to filter the despread signal;

a limiter adapted to adjust an amplitude of the filtered despread signal; and a multiplier adapted to multiply the pseudo noise code and the filtered despread signal to form a reference signal;

wherein said adaptive processor is adapted to determine an error signal by taking a difference of the input radio signals and the reference signal, and said error signal is used to determine optimal weight signals for production by said adaptive processor.

3. The modal antenna system of claim 2, said memory-enhanced spatial filter further comprising a memory storage device connected to said filter and adapted to store said filtered despread signal for recycling.

4. The modal antenna system of claim 2, said memory-enhanced spatial filter further comprising an input diversity signal combiner connected to said adaptive processor and said summing circuit, said input diversity signal combiner adapted to provide an additional reference for control of the adaptive processor.

* * * * *